US012359679B1

(12) United States Patent
Wei et al.

(10) Patent No.: US 12,359,679 B1
(45) Date of Patent: Jul. 15, 2025

(54) BLOWER AND AIR CONDITIONER

(71) Applicants: GD MIDEA HEATING & VENTILATING EQUIPMENT CO., LTD., Foshan (CN); MIDEA GROUP CO., LTD., Foshan (CN)

(72) Inventors: Fuquan Wei, Foshan (CN); Baisong Zhou, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 18/848,781

(22) PCT Filed: Jun. 9, 2023

(86) PCT No.: PCT/CN2023/099511

§ 371 (c)(1),
(2) Date: Sep. 19, 2024

(87) PCT Pub. No.: WO2024/041104

PCT Pub. Date: Feb. 29, 2024

(30) Foreign Application Priority Data

Aug. 23, 2022 (CN) ..... 202211013868.6

(51) Int. Cl.
*F04D 29/66* (2006.01)
*F04D 29/62* (2006.01)
*F24F 1/0022* (2019.01)

(52) U.S. Cl.
CPC ..... *F04D 29/661* (2013.01); *F04D 29/624* (2013.01); *F24F 1/0022* (2013.01)

(58) Field of Classification Search
CPC ..... F04D 29/661; F24F 1/0022
See application file for complete search history.

(56) References Cited

U.S. PATENT DOCUMENTS

| | | | | |
|---|---|---|---|---|
| 10,323,650 | B2 * | 6/2019 | Kosaka | F04D 29/687 |
| 10,634,168 | B2 * | 4/2020 | Kono | F04D 29/666 |
| 11,460,032 | B2 * | 10/2022 | Hu | F04D 29/4226 |
| 2013/0216377 | A1 | 8/2013 | Wang et al. | |
| 2013/0259669 | A1 * | 10/2013 | Tadokoro | F24F 1/0025 415/185 |

FOREIGN PATENT DOCUMENTS

| | | | |
|---|---|---|---|
| CN | 203641081 | U | 6/2014 |
| CN | 104612987 | A | 5/2015 |
| CN | 204692124 | U | 10/2015 |

(Continued)

OTHER PUBLICATIONS

The World Intellectual Property Organization (WIPO) International Search Report for PCT/CN2023/099511 Sep. 7, 2023 6 Pages (including translation).

*Primary Examiner* — Sabbir Hasan
(74) *Attorney, Agent, or Firm* — Anova Law Group, PLLC

(57) ABSTRACT

A blower includes a volute, an impeller rotatably mounted within the volute, and a flexible protective member. The flexible protective member includes a mounting section and a limiting section. The mounting section is detachably fixed at an air inlet of the volute. The limiting section is inserted in an air inlet of the impeller and configured to prevent the impeller from shaking in a radial direction.

20 Claims, 6 Drawing Sheets

(56) References Cited

FOREIGN PATENT DOCUMENTS

| | | | |
|---|---|---|---|
| CN | 110594202 | A | 12/2019 |
| CN | 111425415 | A | 7/2020 |
| CN | 212202545 | U | 12/2020 |
| CN | 215170919 | U | 12/2021 |
| CN | 217979022 | U | 12/2022 |
| FR | 2801941 | A1 | 6/2001 |

* cited by examiner

BLOWER AND AIR CONDITIONER

CROSS-REFERENCE TO RELATED APPLICATIONS

The present application is a National Stage Entry under 35 U.S.C. § 371 of International Application No. PCT/CN2023/099511, filed on Jun. 9, 2023, which claims priority to Chinese patent application filed to CNIPA on Aug. 23, 2022 with application number 202211013868.6 and title "Blower and Air Conditioner," the entire contents of both of which are incorporated herein by reference.

TECHNICAL FIELD

The present disclosure relates to, but is not limited to, the field of electrical device, and particularly relates to a blower and an air conditioner.

BACKGROUND

The blower of an indoor unit of the related air conditioner includes a motor, an impeller and a volute. The volute includes a volute body and a guide ring mounted on the volute body. The motor is positioned on a left or right side of the volute, the impeller is positioned in the volute and mounted on a rotation shaft of the motor, and the impeller forms a cantilever structure. During the falling process of the whole machine, a radial shaking stroke of the impeller is large, and the impeller collides with a circumferential wall of the volute body and the guide ring, causing problems such as jamming and breaking of the impeller.

SUMMARY

The following is a summary of the subject matter described in detail herein. This summary is not intended to limit the protection scope of the claims.

A blower according to an embodiment of the present disclosure includes: a volute; an impeller rotatably mounted within the volute; and a flexible protective member having a limiting section and a mounting section. The mounting section is detachably fixed at an air inlet of the volute, and the limiting section is inserted in an air inlet of the impeller and is configured to prevent the impeller from shaking in the radial direction.

In some exemplary embodiments, a radial distance between the limiting section and a circumferential wall of the air inlet of the impeller is not greater than 15 mm.

In some exemplary embodiments, an outer circumferential surface of the mounting section is provided with a plurality of first bosses at intervals, and boss surfaces of the plurality of first bosses abut against an inner circumferential surface of the air inlet of the volute.

In some exemplary embodiments, a radial height of a first boss is 2 mm to 6 mm.

In some exemplary embodiments, the outer circumferential surface of the mounting segment is provided with a second boss located outside the volute, and a side surface of the second boss facing the volute abuts against an outer end surface of the air inlet of the volute.

In some exemplary embodiments, the second boss includes an annular boss.

In some exemplary embodiments, the second boss includes a plurality of arc-shaped bosses circumferentially arranged at intervals.

In some exemplary embodiments, an end surface of the protective member facing the outside of the volute is provided with a grip part, and the grip part is configured for an operator to install and remove the protective member.

In some exemplary embodiments, the grip part includes one or more gripping holes.

In some exemplary embodiments, the volute includes: a volute body, an end surface of the volute body being provided with an opening; and a guide ring mounted at the opening, the inside of the guide ring forming the air inlet of the volute.

In some exemplary embodiments, the protective member includes a first protective member and a second protective member, the air inlet of the volute includes a first air inlet and a second air inlet, the first protective member is disposed at the first air inlet, and the second protective member is disposed at the second air inlet.

In some exemplary embodiments, a shaft hole is provided at a central axis of the first protective member, a side wall of the first protective member is provided with an opening slit that penetrates both axially and radially, and a radial inner end of the opening slit is communicated with the shaft hole, and a radial outer end of the opening slit is communicated with the outside. The blower further includes a motor located outside the volute, a rotation shaft of the motor is connected with the impeller, and the first protective member is detachably fixed and sleeved on the rotation shaft of the motor by means of the opening slit.

In some exemplary embodiments, a shaft hole is provided at a central axis of the protective member, a side wall of the protective member is provided with an opening slit that penetrates both axially and radially, and a radial inner end of the opening slit is communicated with the shaft hole, and a radial outer end of the opening slit is communicated with the outside. The blower further includes a motor located outside the volute, a rotation shaft of the motor is connected with the impeller, and the protective member is detachably fixed and sleeved on the rotation shaft of the motor by means of the opening slit.

An air conditioner according to an embodiment of the present disclosure includes the blower according to any one of the above embodiments.

The following is a summary of the subject matter described in detail herein. This summary is not intended to limit the protection scope of the claims.

Figure 1:
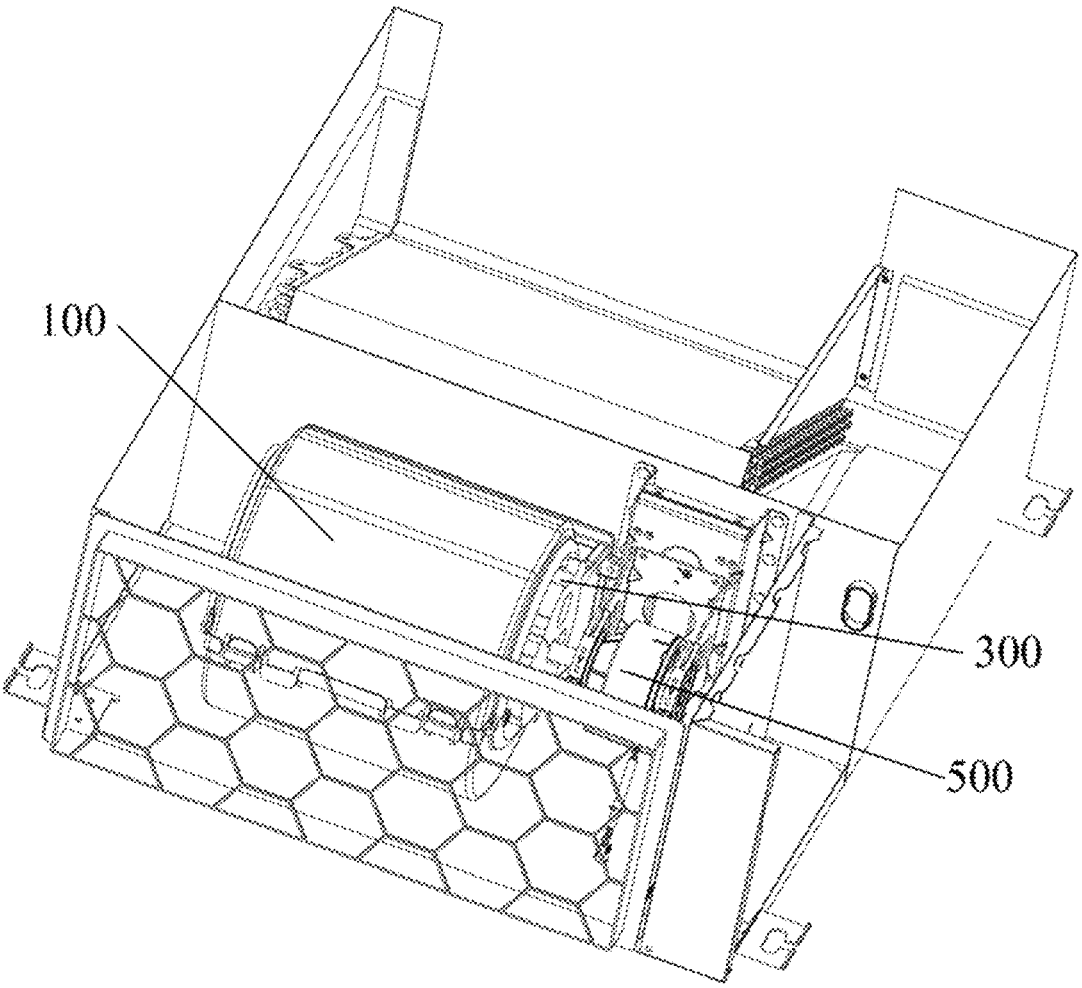
FIG. 1 is a schematic three-dimensional structural diagram of an air conditioner from one perspective according to some embodiments of the present disclosure.

The relationship between reference signs and component names in FIG. 1 to FIG. 7 is as follows:

100 volute, 110 volute body, 111 first air inlet, 112 second air inlet, 120 guide ring, 200 impeller, 300 first protective member, 310 limiting section, 320 mounting section, 321 first boss, 322 second boss, 323 grip part, 330 shaft hole, 340 opening slit, 400 second protective member, 410 limiting section, 420 mounting section, 421 first boss, 422 second boss, 423 grip part, 500 motor.

DETAILED DESCRIPTION

A clear and complete description of the technical schemes of the embodiments of the present disclosure will be given below in conjunction with the accompanying drawings in the embodiments of the present disclosure. It will be apparent that the described embodiments are only a part, rather than all, of the embodiments of the present disclosure. Based on the embodiments in the present disclosure, all other embodiments obtained without paying creative effort by those of ordinary skill in the art fall within the scope of protection of the present disclosure.

It should be noted that all directivity indications (such as up, down, left, right, front, back, etc.) in the embodiments of the present disclosure are only used to explain a relative positional relationship, a motion situation, etc., among various components under a specific posture (as shown in the accompanying drawings), and if the specific posture changes, the directivity indications will change accordingly.

In addition, descriptions such as those relating to "first," "second" and the like in the present disclosure are intended for descriptive purposes only and cannot be construed as indicating or implying their relative importance or implying the number of technical features indicated. Thus, the features defined with "first" or "second" may explicitly or implicitly include at least one of the features. In the description of the present disclosure, "a plurality of/multiple" means at least two, e.g., two, three, and the like, unless explicitly and specifically defined otherwise.

In the present disclosure, the terms "mounting," "join," "connection," "fixation" and the like should be understood in a broad sense unless otherwise expressly specified and limited. For example, "fixation" may be a fixed connection, may be a detachable connection, or may be an integrated connection; may be a mechanical connection or an electrical connection. "Connection" may be a direct connection or an indirect connection through an intermediate medium, or may be an internal connection between two elements or an interactive relationship between two elements, unless otherwise expressly defined. For those of ordinary skills in the art, the specific meanings of the above terms in the present disclosure can be understood according to specific situations.

In addition, the technical solutions in the various embodiments of the present disclosure may be combined with each other, but it is needed to be on the basis that the person of ordinary skill in the art can realize it. When the combination of technical solutions is contradictory or impossible to realize, it should be considered that such combination of technical solutions does not exist and is not within the scope of protection claimed by the present disclosure.

A main object of the present disclosure is to provide a blower capable of avoiding jamming and breaking of an impeller.

A main object of the present disclosure is to also provide an air conditioner.

Figure 2:
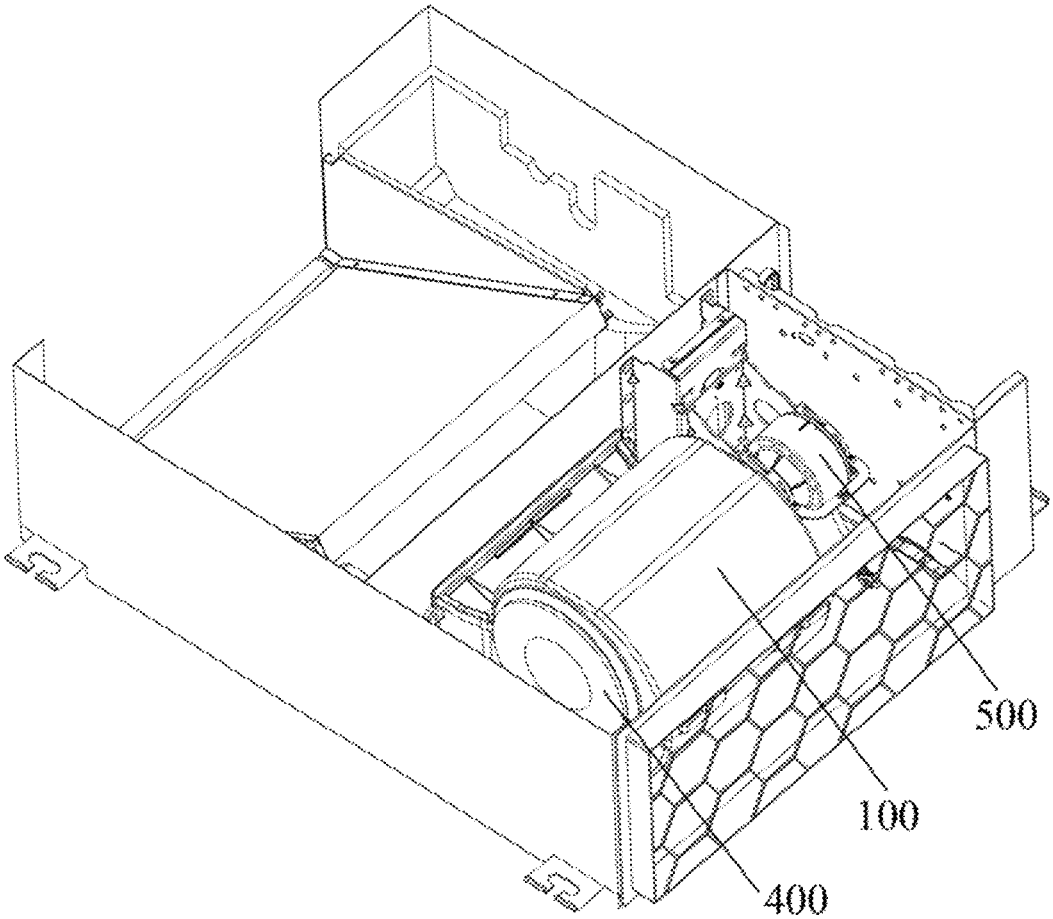
FIG. 2 is a schematic three-dimensional structural diagram of the air conditioner shown in FIG. 1 from another perspective.
Figure 3:
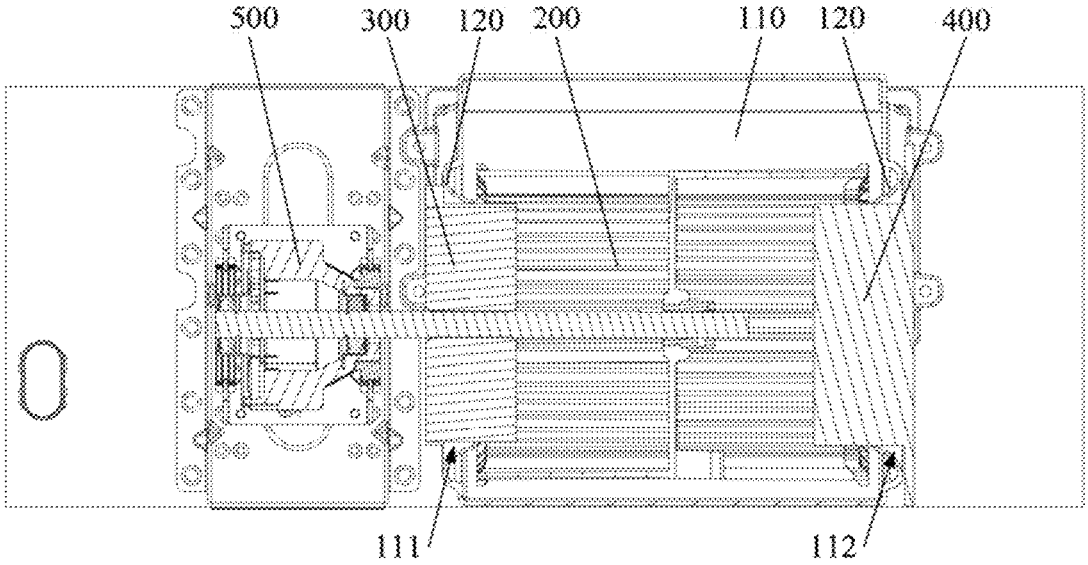
FIG. 3 is a schematic cross-sectional structural diagram of the air conditioner shown in FIG. 1.
Figure 4:
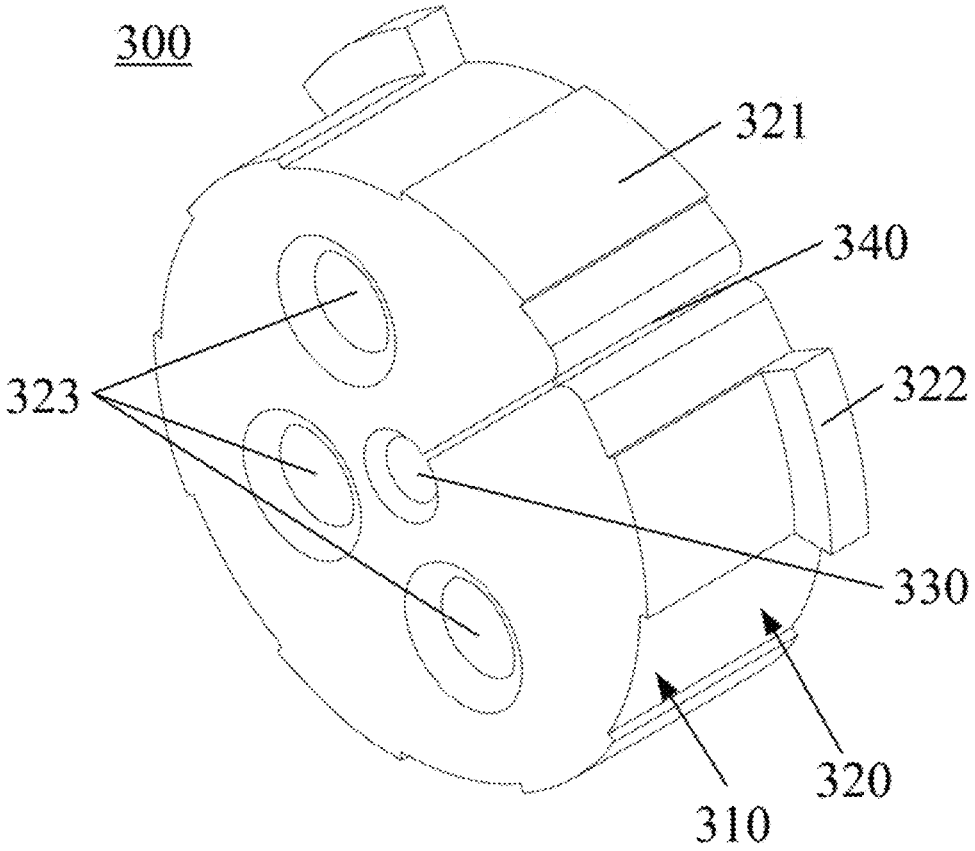
FIG. 4 is a schematic three-dimensional structural diagram of a first protective member in FIG. 3.
Figure 5:
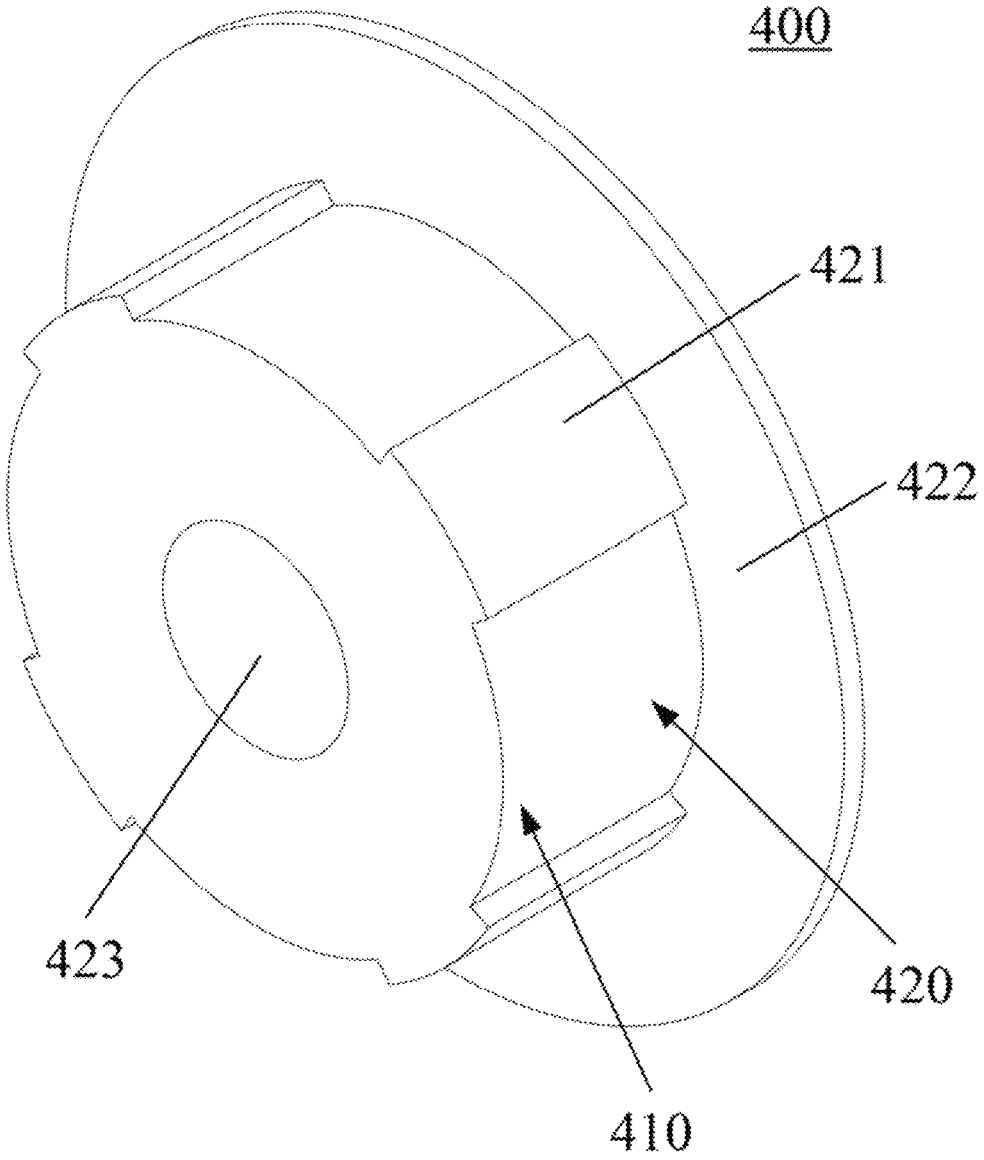
FIG. 5 is a schematic three-dimensional structural diagram of a second protective member in FIG. 3.
Figure 6:
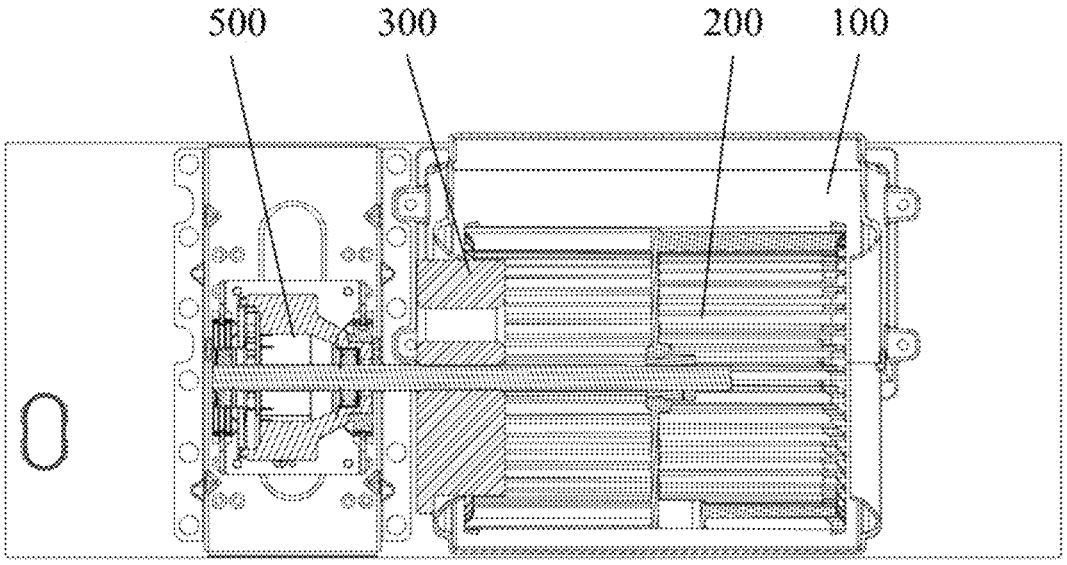
FIG. 6 is a schematic cross-sectional structural diagram of an air conditioner according to some other embodiments of the present disclosure.
Figure 7:
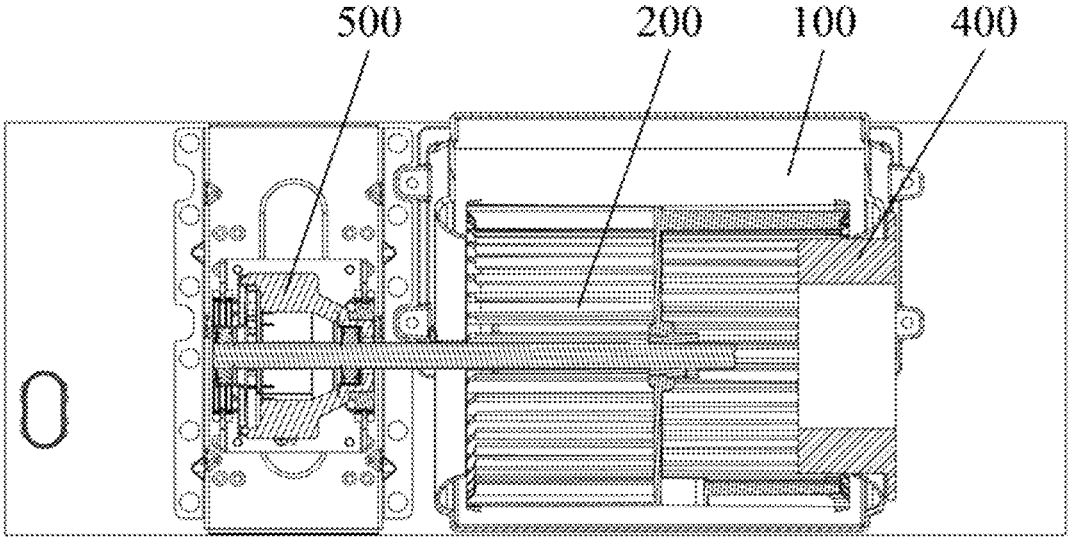
FIG. 7 is a schematic cross-sectional structural diagram of an air conditioner according to still some embodiments of the present disclosure.

FIG. 1 is a schematic three-dimensional structural diagram of an air conditioner according to an embodiment of the present disclosure from one perspective. FIG. 2 is a schematic three-dimensional structural diagram of the air conditioner shown in FIG. 1 from another perspective. FIG. 3 is a schematic cross-sectional structural diagram of the air conditioner shown in FIG. 1. FIG. 4 is a schematic three-dimensional structural diagram of a first protective member in FIG. 3. FIG. 5 is a schematic three-dimensional structural diagram of a second protective member in FIG. 3. FIG. 6 is a schematic cross-sectional structural diagram of an air conditioner according to another embodiment of the present disclosure. FIG. 7 is a schematic cross-sectional structural diagram of an air conditioner according to still another embodiment of the present disclosure.

As shown in FIGS. 1 to 3, 6 and 7, a blower according to an embodiment of the present disclosure includes: a volute 100; an impeller 200 rotatably mounted within the volute 100; and a flexible protective member. The protective member has a limiting section and a mounting section, the mounting section is detachably fixed at an air inlet of the volute 100, and the limiting section is inserted in an air inlet of the impeller 200 and is configured to prevent the impeller 200 from shaking in the radial direction.

In the blower, the mounting section of the protective member is detachably fixed at the air inlet of the volute 100, the limiting section of the protective member is inserted in the air inlet of the impeller 200. The blower is applied to an air conditioner, and when the air conditioner falls, the flexible protective member prevents the impeller 200 from shaking in the radial direction, effectively avoiding problems such as jamming and breaking of the impeller 200. After the air conditioner is mounted, the protective member can be detached, and the protective member will not affect the normal air intake of the blower.

In some exemplary embodiments, as shown in FIGS. 3, 6, and 7, a radial distance between the limiting section and a circumferential wall of the air inlet of the impeller 200 is not more than 15 mm. The blower is applied to an air conditioner, and when the air conditioner falls, the flexible protective member can better prevent the impeller 200 from shaking in the radial direction, and the impeller 200 will not have problems such as jamming and breaking.

The radial distance between the limiting section and the circumferential wall of the air inlet of the impeller 200 may be set to 5 mm. Alternatively, the radial distance between the limiting section and the circumferential wall of the air inlet of the impeller 200 may be set to 10 mm. Alternatively, the radial distance between the limiting section and the circumferential wall of the air inlet of the impeller 200 may be set to 15 mm or the like. All of the above can achieve the purpose of the present application, and the tenet thereof does not deviate from the design idea of the present disclosure, so it will not be repeated herein, and all of them should fall within the scope of protection of the present application.

In some exemplary embodiments, as shown in FIG. 3, the volute 100 includes: a volute body 110, each of both end walls of the volute body 110 being provided with an opening; and two guide rings 120 mounted at two openings in one-to-one correspondence, the inside of the two guide rings 120 forming two air inlets of the volute 100. The two air inlets of the volute 100 include a first air inlet 111 and a second air inlet 112. As shown in FIGS. 1 to 5, the protective member includes a first protective member 300 and a second protective member 400. The first protective member 300 is disposed at the first air inlet 111, and the second protective member 400 is provided at the second air inlet 112. By limiting both ends of the impeller 200 through the first protective member 300 and the second protective member 400, it is possible to better prevent the impeller 200 from shaking in the radial direction.

The structure of the first protective member 300 will be described in detail below.

In some examples, as shown in FIG. 4, a shaft hole 330 is provided at a central axis of the first protective member 300, a side wall of the first protective member 300 is provided with an opening slit 340 that penetrates both axially and radially, a radial inner end of the opening slit 340 is communicated with the shaft hole 330, and a radial outer end of the opening slit 340 is communicated with the outside. The blower further includes a motor 500, the motor 500 is located outside the volute 100, a rotation shaft of the motor 500 is connected with the impeller 200, and the first protective member 300 is detachably fixed and sleeved on the rotation shaft of the motor 500 by means of the opening slit 340. After the air conditioner is mounted, the first protective member 300 is detached from the rotation shaft of the motor 500 by means of the opening slit 340, so that the first protective member 300 does not affect the normal air intake of the blower. The limiting section 310 of the first protective member 300 is inserted in one of the air inlets of the impeller 200.

In some examples, as shown in FIG. 4, an outer circumferential surface of the mounting section 320 of the first protective member 300 is provided with a plurality of first bosses 321 at intervals, and boss surfaces of the plurality of first bosses 321 abut against an inner circumferential surface of the first air inlet 111 to ensure that the mounting section 320 and the inner circumferential surface of the first air inlet 111 will not detach spontaneously, and a friction force between the mounting section 320 and the inner circumferential surface of the first air inlet 111 is reduced, which is convenient for the operator to mount the first protective member 300 to the volute 100 and detach the first protective member 300 from the volute 100. The plurality of first bosses 321 are uniformly arranged along the circumferential direction so that the guide ring 120 is not squeezed and deformed.

Furthermore, the blower is applied to an air conditioner, and when the air conditioner is dropped, a hole wall of the shaft hole 330 radially positions and supports the rotation shaft of the motor 500 to prevent the rotation shaft of the motor 500 from shaking in the radial direction, thus effectively preventing the impeller 200 from shaking in the radial direction.

The plurality of first bosses 321 may be two first bosses 321. Alternatively, the plurality of first bosses 321 may be three first bosses 321. Alternatively, the plurality of first bosses 321 may be four first bosses 321 or the like. All of the above can achieve the purpose of the present application, and the tenet thereof does not deviate from the design idea of the present disclosure, so it will not be repeated herein, and all of them should fall within the scope of protection of the present application.

In some embodiments, a radial height of a first boss 321 is 2 mm to 6 mm. The radial height of the first boss 321 may be 2 mm. Alternatively, the radial height of the first boss 321 is 4 mm. Alternatively, the radial height of the first boss 321 may be 6 mm or the like. All of the above can achieve the purpose of the present application, and the tenet thereof does not deviate from the design idea of the present disclosure, so it will not be repeated herein, and all of them should fall within the scope of protection of the present application.

In some examples, as shown in FIG. 4, the outer circumferential surface of the mounting section 320 of the first protective member 300 is further provided with a second boss 322. The second boss 322 is located outside the volute 100, and a side surface of the second boss 322 facing the volute 100 abuts against an outer end surface of the first air inlet 111 to prevent the first protective member 300 from completely entering the inside of the volute 100 from the first air inlet 111, the complete entering will result in loss of the protective function of the first protective member 300.

The second boss 322 may be an annular boss. Alternatively, the second boss 322 may be a plurality of arc-shaped bosses or the like circumferentially arranged at intervals. All of the above can achieve the purpose of the present application, and the tenet thereof does not deviate from the design idea of the present disclosure, so it will not be repeated herein, and all of them should fall within the scope of protection of the present application.

In some examples, as shown in FIG. 4, an end surface of the first protective member 300 facing the outside of the volute 100 is provided with a grip part 323, and the grip part 323 is provided for an operator to quickly detach and assemble the first protective member 300, thereby reducing the difficulty of operation.

In some embodiments, as shown in FIG. 4, the grip part 323 includes a plurality of gripping holes, and the plurality of gripping holes are positioned alongside the shaft hole 330 and penetrate the first protective member 300 in the axial direction. Fingers may insert into the plurality of gripping holes to quickly remove the first protective member 300.

The structure of the second protective member 400 will be described in detail below.

In some examples, as shown in FIG. 5, an outer circumferential surface of the mounting section 420 of the second protective member 400 is provided with a plurality of first bosses 421 at intervals, and boss surfaces of the plurality of first bosses 421 abut against an inner circumferential surface of the second air inlet 112 to ensure that the mounting section 420 and the inner circumferential surface of the second air inlet 112 will not detach spontaneously, and a friction force between the mounting section 420 and the inner circumferential surface of the second air inlet 112 is reduced, which is convenient for the operator to mount the second protective member 400 to the volute 100 and detach the second protective member 400 from the volute 100. The plurality of first bosses 421 are uniformly arranged along the circumferential direction so that the guide ring 120 is not squeezed and deformed. The limiting section 410 of the second protective member 400 is inserted in another air inlet of the impeller 200.

The plurality of first bosses 421 may be two first bosses 421. Alternatively, the plurality of first bosses 421 may be three first bosses 421. Alternatively, the plurality of first bosses 421 may be four first bosses 421 or the like. All of the above can achieve the purpose of the present application, and the tenet thereof does not deviate from the design idea of the present disclosure, so it will not be repeated herein, and all of them should fall within the scope of protection of the present application.

In some embodiments, a radial height of a first boss 421 is 2 mm to 6 mm. The radial height of the first boss 421 may be 2 mm. Alternatively, the radial height of the first boss 421 is 4 mm. Alternatively, the radial height of the first boss 421 may be 6 mm or the like. All of the above can achieve the purpose of the present application, and the tenet thereof does not deviate from the design idea of the present disclosure, so it will not be repeated herein, and all of them should fall within the scope of protection of the present application.

In some examples, as shown in FIG. 5, the outer circumferential surface of the mounting section 420 of the second protective member 400 is further provided with a second boss 422. The second boss 422 is located outside the volute 100, and a side surface of the second boss 422 facing the volute 100 abuts against an outer end surface of the second air inlet 112 to prevent the second protective member 400 from completely entering the inside of the volute 100 from the second air inlet 112, the complete entering will result in loss of the protective function of the second protective member 400.

The second boss 422 may be an annular boss. Alternatively, the second boss 422 includes a plurality of arc-shaped bosses or the like circumferentially arranged at intervals. All of the above can achieve the purpose of the present application, and the tenet thereof does not deviate from the design idea of the present disclosure, so it will not be repeated herein, and all of them should fall within the scope of protection of the present application.

In some examples, as shown in FIG. 5, an end surface of the second protective member 400 facing the outside of the volute 100 is provided with a grip part 423, and the grip part 423 is provided for an operator to quickly detach and assemble the second protective member 400, thereby reducing the difficulty of operation.

In some embodiments, as shown in FIG. 5, the grip part 423 includes a gripping hole provided at a central axis of the second protective member 400, and the gripping hole penetrates the second protective member 400 in the axial direction. A finger may insert into the gripping hole to quickly remove the second protective member 400.

Alternatively, as shown in FIG. 6, only the first air inlet 111 is mounted with the first protective member 300. Alternatively, as shown in FIG. 7, only the second air inlet 112 is mounted with the second protective member 400. All of the above can achieve the purpose of the present application, and the tenet thereof does not deviate from the design idea of the present disclosure, so it will not be repeated herein, and all of them should fall within the scope of protection of the present application.

As shown in FIGS. 1 to 3, 6, and 7, the air conditioner according to an embodiment of the present disclosure includes the blower described in any of the above embodiments.

The air conditioner has all the advantages of the blower according to any one of the above-described embodiments, which will not be repeatedly described herein.

To sum up, in the technical schemes of the present disclosure, the mounting section of the protective member is detachably fixed at the air inlet of the volute, and the limiting section of the protective member is inserted in the air inlet of the impeller. The blower is applied to an air conditioner, and when the air conditioner falls, the flexible protective member prevents the impeller from shaking in the radial direction, effectively avoiding problems such as jamming and breaking of the impeller. After the air conditioner is mounted, the protective member can be detached, and the protective member will not affect the normal air intake of the blower.

Although implementations disclosed in the present disclosure are described above, the described contents are only implementations used for facilitating understanding of the present disclosure, and are not intended to limit the present disclosure. Without departing from the spirit and scope disclosed in the present disclosure, any person skilled in the art to which the present disclosure pertains may make any modifications and changes in the form and details of implementation, but the scope of patent protection of the present disclosure shall still be defined by the appended claims.

The above descriptions are only optional embodiments of the present disclosure, and therefore do not limit the patent scope of the present disclosure. Equivalent structural transformation made by using the contents of the description and drawings of the present disclosure, or direct/indirect application in other related technical fields, within the concept of the present disclosure, is included in the patent protection scope of the present disclosure.

The invention claimed is:

1. A blower comprising:
- a volute;
- an impeller rotatably mounted within the volute; and
- a flexible protective member including:
  - a mounting section detachably fixed at an air inlet of the volute; and
  - a limiting section inserted in an air inlet of the impeller and configured to prevent the impeller from shaking in a radial direction.

2. The blower according to claim 1, wherein a radial distance between the limiting section and a circumferential wall of the air inlet of the impeller is not greater than 15 mm.

3. The blower according to claim 1, wherein an outer circumferential surface of the mounting section is provided with a plurality of bosses at intervals, and boss surfaces of the plurality of bosses abut against an inner circumferential surface of the air inlet of the volute.

4. The blower according to claim 3, wherein a radial height of one of the plurality of bosses is 2 mm to 6 mm.

5. The blower according to claim 1, wherein an outer circumferential surface of the mounting section is provided with a boss located outside the volute, and a side surface of the boss facing the volute abuts against an outer end surface of the air inlet of the volute.

6. The blower according to claim 5, wherein the boss includes an annular boss.

7. The blower according to claim 5, wherein the boss includes a plurality of arc-shaped bosses circumferentially arranged at intervals.

8. The blower according to claim 1, wherein an end surface of the protective member facing outside of the volute is provided with a grip part configured for an operator to install and remove the protective member.

9. The blower according to claim 8, wherein the grip part includes one or more gripping holes.

10. The blower according to claim 1, wherein the volute includes:
- a volute body, an end surface of the volute body being provided with an opening; and
- a guide ring mounted at the opening, an inside of the guide ring forming the air inlet of the volute.

11. The blower according to claim 1, wherein the protective member includes a first protective member and a second protective member, the air inlet of the volute includes a first air inlet and a second air inlet, the first protective member is disposed at the first air inlet, and the second protective member is disposed at the second air inlet.

12. The blower according to claim 11, further comprising:
- a motor positioned outside the volute;
- wherein:
  - a shaft hole is provided at a central axis of the first protective member;
  - a side wall of the first protective member is provided with an opening slit that penetrates both axially and radially, a radial inner end of the opening slit is communicated with the shaft hole, and a radial outer end of the opening slit is communicated with outside;

a rotation shaft of the motor is connected with the impeller; and the first protective member is detachably fixed and sleeved on the rotation shaft of the motor by means of the opening slit.

13. The blower according to claim 1, further comprising:

a motor positioned outside the volute;

wherein:

a shaft hole is provided at a central axis of the protective member;

a side wall of the protective member is provided with an opening slit that penetrates both axially and radially, a radial inner end of the opening slit is communicated with the shaft hole, and a radial outer end of the opening slit is communicated with outside;

a rotation shaft of the motor is connected with the impeller; and the protective member is detachably fixed and sleeved on the rotation shaft of the motor by means of the opening slit.

14. An air conditioner comprising:

a blower including:

a volute;

an impeller rotatably mounted within the volute; and a flexible protective member including:

a mounting section detachably fixed at an air inlet of the volute; and a limiting section inserted in an air inlet of the impeller and configured to prevent the impeller from shaking in a radial direction.

15. The air conditioner according to claim 14, wherein a radial distance between the limiting section and a circumferential wall of the air inlet of the impeller is not greater than 15 mm.

16. The air conditioner according to claim 14, wherein an outer circumferential surface of the mounting section is provided with a plurality of bosses at intervals, and boss surfaces of the plurality of bosses abut against an inner circumferential surface of the air inlet of the volute.

17. The air conditioner according to claim 16, wherein a radial height of one of the plurality of bosses is 2 mm to 6 mm.

18. The air conditioner according to claim 14, wherein an outer circumferential surface of the mounting section is provided with a boss located outside the volute, and a side surface of the boss facing the volute abuts against an outer end surface of the air inlet of the volute.

19. The air conditioner according to claim 18, wherein the boss includes an annular boss.

20. The air conditioner according to claim 18, wherein the boss includes a plurality of arc-shaped bosses circumferentially arranged at intervals.

* * * * *